US011828181B2

(12) United States Patent
Tuckey

(10) Patent No.: US 11,828,181 B2
(45) Date of Patent: Nov. 28, 2023

(54) ROTARY PUMP WITH DISCHARGE CONTROL

(71) Applicant: Charles H. Tuckey, Cass City, MI (US)

(72) Inventor: Charles H. Tuckey, Cass City, MI (US)

( * ) Notice: Subject to any disclaimer, the term of this patent is extended or adjusted under 35 U.S.C. 154(b) by 0 days.

(21) Appl. No.: 17/500,240

(22) Filed: Oct. 13, 2021

(65) Prior Publication Data

US 2022/0112808 A1 Apr. 14, 2022

Related U.S. Application Data

(60) Provisional application No. 63/090,790, filed on Oct. 13, 2020.

(51) Int. Cl.
*F03C 2/00* (2006.01)
*F03C 4/00* (2006.01)
(Continued)

(52) U.S. Cl.
CPC ..... *F01C 21/108* (2013.01); *F04C 2/44* (2013.01); *F04C 14/04* (2013.01); *F04C 15/0026* (2013.01); *F04C 15/068* (2013.01)

(58) Field of Classification Search
CPC ..... F01C 21/108; F04C 2/344; F04C 2/44; F04C 14/04; F04C 14/10; F04C 14/12;
(Continued)

(56) References Cited

U.S. PATENT DOCUMENTS 2,487,685 A * 11/1949 Young ..... F04C 2/44 418/265
3,515,496 A * 6/1970 Eddy ..... F04C 14/14 418/167

(Continued)

FOREIGN PATENT DOCUMENTS

JP 09119387 A * 5/1997 ..... F04C 29/00

OTHER PUBLICATIONS

JP-09119387-A—Makihira—Discharge Valve Fixing Device—May 6, 1997—the English Machine Translation. (Year: 1997).*

*Primary Examiner* — Theresa Trieu
(74) *Attorney, Agent, or Firm* — Robert L. Stearns; Dickinson Wright PLLC

(57) ABSTRACT

A positive displacement rotary fluid pump assembly includes a pump housing and a rotor supported within the housing for rotation about an axis offset with respect to a housing axis and including a plurality of chambers of increasing volume on an low pressure side of the pump and of decreasing volume on a high pressure side of the pump. A fluid inlet communicates with the plurality of the chambers of increasing volume for admitting fluid into the pump under a first low pressure, and a fluid outlet communicates with a plurality of the chambers of decreasing volume for selectively expelling fluid from the pump under a second higher pressure. At least one fluid control valve is operative to selectively close one or more of the chambers of decreasing volume from communication with the fluid outlet when the fluid pressure in such chambers is below the predetermined value and to open one or more other chambers of decreasing volume when the fluid pressure in such chambers is at or above the predetermined value.

3 Claims, 5 Drawing Sheets

(51) Int. Cl.

| | |
|---|---|
| ***F04C 2/00*** | (2006.01) |
| ***F04C 15/00*** | (2006.01) |
| ***F01C 21/10*** | (2006.01) |
| ***F04C 14/04*** | (2006.01) |
| ***F04C 2/44*** | (2006.01) |
| ***F04C 15/06*** | (2006.01) |

(58) Field of Classification Search
CPC .... F04C 14/14; F04C 15/0026; F04C 15/064; F04C 15/066; F04C 15/068; F04C 2220/20; F04C 2240/20
See application file for complete search history.

(56) References Cited

U.S. PATENT DOCUMENTS

| | | | | |
|---|---|---|---|---|
| 3,809,511 | A * | 5/1974 | Linder | F04C 2/3446 418/259 |
| 4,199,309 | A * | 4/1980 | Connor | F04C 29/128 418/270 |
| 4,247,267 | A * | 1/1981 | Lindtveit | F04C 14/04 418/32 |
| 4,501,535 | A * | 2/1985 | Golobay | F04C 15/0026 418/78 |
| 4,523,897 | A * | 6/1985 | Lower | F04C 23/001 418/13 |
| 2005/0142019 | A1 * | 6/2005 | Lee | F04C 29/128 418/270 |

* cited by examiner

ROTARY PUMP WITH DISCHARGE CONTROL

CROSS-REFERENCE TO RELATED APPLICATION

This U.S. Utility Patent Application claims priority to U.S. Provisional Application Ser. No. 63/090,790, filed Oct. 13, 2020, the entire contents of which are incorporated herein by reference.

BACKGROUND OF THE INVENTION

1. Technical Field

This invention related generally to positive displacement rotary pumps and more particularly to means for controlling the discharge of fluid from such pumps.

2. Related Art

Positive displacement rotary pumps are designed to transport fluid by drawing it in on a suction side of the pump and expelling it on a discharge side through relative movement of pumping elements of the pump.

One type of positive displacement pump is a vane pump which typically includes a rotor housed within a pump housing and supporting a series of moveable vanes. The rotor rotates about an axis that is eccentric relative to an inner ring surface of the housing and closed at the sides by a pair of housing end plates. The geometries of the offset rotor and inner ring surface create a crescent-shaped space that is narrowest at a close point where the surfaces nearly touch. The space progressively widens away from the close point along a suction side of the pump before transitioning onto the discharge side where the space then progressively narrows as it moves toward the close point. A suction port is provided on the suction side and is in communication with a portion the widening space, whereas a discharge port is provided on the discharge side in communication with a portion of the narrowing space. The moveable vanes are caused to move outwardly and inwardly relative to the rotor during operation of the pump so as to maintain engagement with the eccentric inner ring surface. As the vanes sweep along the suction port, a fluid such as air is caused to be drawn into the space and when the vanes move past the suction port a fixed amount of the fluid becomes captured in a series of chambers defined between adjacent pairs of the vanes which transport the fluid toward the discharge side of the pump. When the fluid progresses to the discharge side, the narrowing of the space between the rotor and inner wall causes the fluid trapped in the chambers to progressively increase in pressure before being expelled out of the pump through the discharge port. Gerotor pumps are another type of positive displacement rotary pump, wherein inner and outer rotors with n and n+1 gears create captured volumes of increasing and decreasing spaces which draw fluid in from a suction port and expel the fluid under higher pressure through a discharge port.

The discharge port of rotary displacement pumps is open to several of the chambers on the discharge side and as the fluid pressure builds in the chambers as a result of the decreasing volume of the chambers, the fluid to pushed into the discharge port. One disadvantage of such an open port design is that the relatively higher pressure fluid entering the port from the chambers as they approach the close point creates a certain amount of back pressure in the trailing chambers which are under lower pressure but also open to the discharge port. This creates inefficiencies in the operation of the pump since the vanes of the trailing chambers must push against a head of higher pressure fluid in order to advance toward the close point, as the pressure in the trailing chambers is relatively lower than that seen ahead of the leading vane of the trailing chambers.

SUMMARY

A positive displacement rotary vane pump includes a pump housing with a suction port on a suction side of the pump and a discharge port on a discharge side of the pump. The pump includes a pump housing and pumping elements which create chambers of increasing volume on the suction side and decreasing volume on the discharge side. The chambers of increasing volume draw in and capture fluid from the suction port and as the pumping elements rotate the captured fluid is transported to the discharge side and progressively pressurized as the chambers decrease in volume as they approach a close point of the pump. The discharge port communicates with a leading chamber on the discharge side having relatively high fluid pressure and at least one trailing chamber of relatively lower fluid pressure. A flow control valve is disposed between the discharge chambers and the discharge port and is operative to enable selective discharge of fluid from a leading chambers while isolating the trailing chambers from backflow of the relatively higher pressure fluid discharged from the leading chambers.

The flow control valve make take different forms and may comprise, for example, one or more reed-type valves that overlie a discharge port in an end plate of the housing. As fluid pressure builds in each of the discharge chambers toward movement to the close point, the positive pressure on one the chamber side of the reed pushes the reed out of sealed contact and permits the fluid to pass into the outlet port. The reed valve (or portion thereof) associated with the one or more trailing discharge chambers remains closed to the extent the pressure on the discharge port side exceeds that of the pressure in the trailing chambers, thus precluding high pressure fluid from backing up into the trailing chambers. When the pressure in the trailing chambers builds to the point where it exceeds the pressure seen on the opposite discharge side of the reed valve, the reed valve is caused to open and let the fluid pass out of the trailing chamber.

Another form of a flow control valve may comprise individual valves fitted on the rotor and associated with each chamber. In the area between adjacent vanes (i.e., in each of the chambers), the rotor can include an outlet that communicates with the discharge port when the associated chamber is rotated to suction side of the pump. When the pressure builds in the chambers sufficiently high to overcome the closing force of the valve, the valve in such chamber opens and releases the pressurized fluid from that chamber. The valves in the other trailing chambers remained closed, so that no fluid from the leading chamber can back up into the trailing chambers, and only open when the pressure in the trailing chambers exceeds the outlet port chamber on the opposite side of the associated valve.

The flow control valve system is equally applicable to positive displacement rotary pumps of the vane and gerotor type.

The flow control valve system thus retains all of the benefits of positive displacement rotary pumps while reducing or eliminating the inefficiencies associated with the backflow of high pressure fluid from the higher pressure leading chambers flowing into the trailing chambers. The valve system acts to seal each of the discharge chambers from any inflow of pressurized fluids from the discharge port. The valve(s) open only when the pressure in any given discharge port exceeds the closing force of the valve(s), attributed principally to the higher pressure fluid in the discharge chamber acting on the back of the valve(s) in the trailing chambers. In other words, the valve(s) are unidirectional or one-way in design and operation and prevent high pressure fluid that has been pumped out of a leading chamber from contacting the trailing chambers. The one-way valve(s) could be a reed valve, a flap valve, a ball valve or other types of valves that would achieve the intended purpose.

THE DRAWINGS

These and other features and advantages of embodiments of the invention will become better understood when considered in connection with the following representative drawings and detailed description of preferred embodiments, in which.

DETAILED DESCRIPTION

Figure 1:
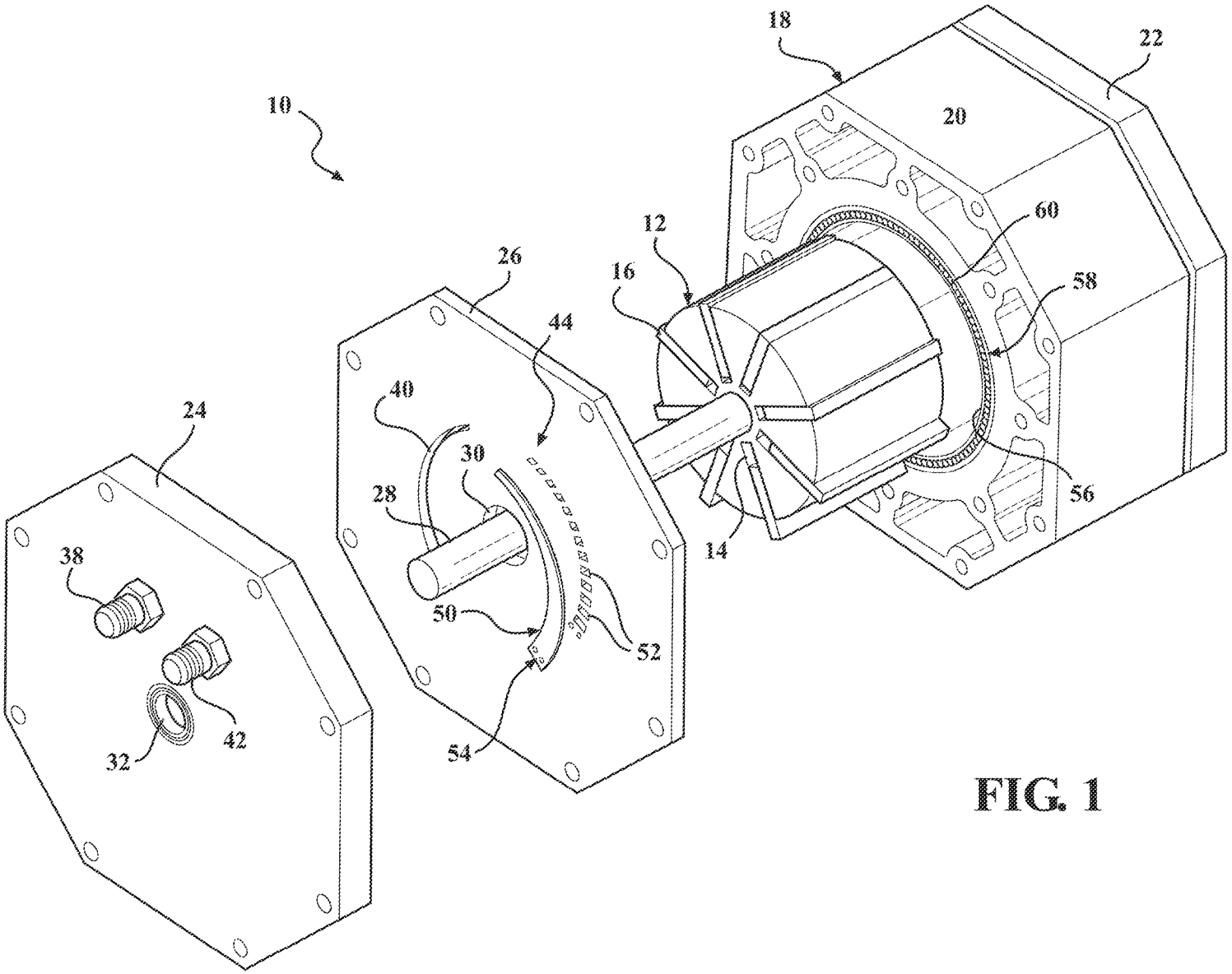
FIG. 1 is an exploded fragmentary perspective view of a positive displacement vane pump according to an embodiment of the invention.

FIG. 1 illustrates a positive displacement rotary pump 10 constructed according to a first exemplary embodiment. The pump 10 of this embodiment is a sliding vane pump and includes a rotor 12 having a plurality of radial slots 14 in which a corresponding plurality of vanes 16 are supported. The pump 10 includes a housing 18 having an inner wall 20 that has an associated inner wall axis. The housing 18 is closed at its opposite axial ends. As illustrated, the housing 18 may be closed at back end by a first end plate 22. The opposite front end of the housing 18 may be closed by a second end plate 24 and an intervening valve plate 26.

Figure 2:
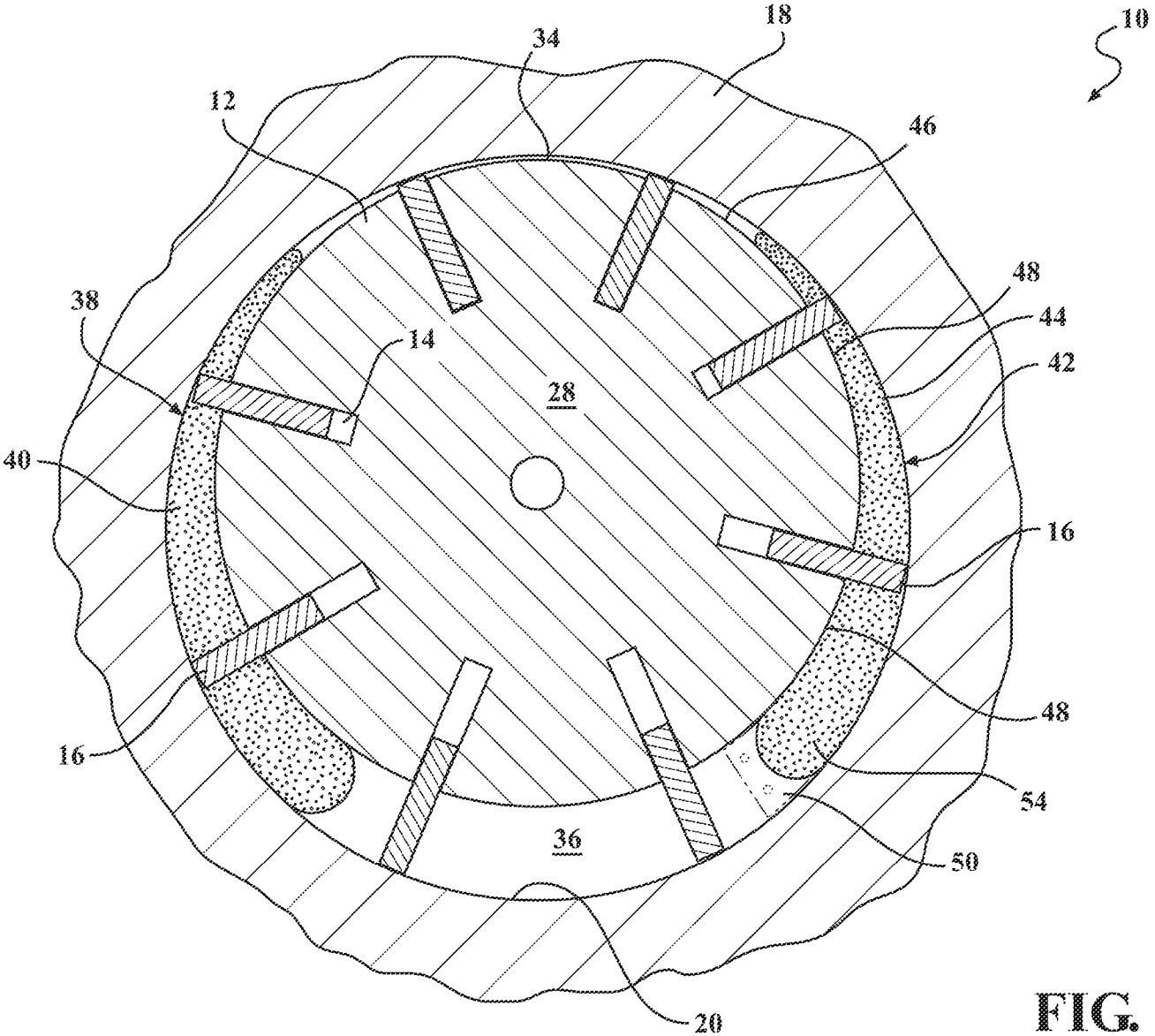
FIG. 2 is a fragmentary cross-sectional view of the vane pump of FIG. 1.

The rotor 12 is mounted on a shaft 28 that extends through an opening 30 in the valve plate 26 and which is supported for driven rotation about a rotor axis by external means, such as a motor or engine. The shaft 28 is suitably supported by at least one and preferably both end plates with bearing(s) 32. The rotor 12 may extend through one of the end plates 24 for engagement by the driving mechanism. The rotor 12 and vanes 16 are disposed within the space defined by the inner wall 20 and end plates 22, 24 and intervening valve plate 26. The axis of the rotor is offset eccentrically relative to the inner wall axis. Both the outer surface of the rotor 12 and the inner wall 20 of the housing 18 are preferably cylindrical and with that of the rotor 12 being smaller in diameter and axially offset but with their respective surfaces arranged very close together at a close point 34 of the pump 10. The geometries and offset placement define a crescent-shaped space 36 between the rotor 12 and inner wall 20 that is near zero in clearance at the close point 34 and widest opposite the close point, as illustrated also in FIG. 2.

The pump 10 includes a fluid inlet 38 that communicates with a part-crescent-shaped inlet port 40 of the valve plate 26. The pump further includes a fluid outlet 42 that communicates with a fluid outlet port 44 of the valve plate 26. The direction of rotation of the shaft 28 in the illustrated pump 10 of FIG. 1 is counterclockwise. With rotation of the rotor 12, the vanes 16 are caused to slide outward in their slots 14 and engage and keep contact with the inner wall 20 during operation of the pump 10. As the vanes sweep by the elongated inlet port 40, a suction is created which draws fluid (such as air) into the pump 10 As the vanes move past the inlet port 40, a fixed amount of air is trapped between the adjacent pair of vanes 16 that have just swept by, the plates 22, 24, 26, the rotor 12 and inner wall 20. As the rotor 12 continues to rotate, the entrapped fluid is transported by the moving chamber from the inlet or suction side of the pump 10 to the outlet or discharge side of the pump. One the discharge side, the crescent-shaped portion of the space 36 is progressively diminishing in size as rotation moves toward the close point. The trapped fluid is pressurized as the chamber 46 progressively decreases in volume as it moves toward the close point 34. Successive one of the vanes passing by the inlet port 40 entrap subsequent volumes of air in trailing chambers 48. It will be appreciated that the leading-most chamber 46 at or near the close point 34 is smallest in volume and its fluid is under the highest pressure, whereas the one or more trailing chambers 48 have trapped fluid that is under progressively less fluid pressure.

The chambers 46, 48 on the discharge side of the pump 10 are in communication with the discharge port 44, 42. The discharge port 42 is fitted with a control valve 50 that allows pressured fluid to escape from the chambers 46, 48 into the outlet 42, but not to return. The discharge port 44 is preferably segmented such that a plurality discrete openings 52 are a provided that are open to the discharge side of the space 36, but which are walled off from one another by intervening wall segments. The valve 50 includes a reed 54 that is secured to an outer surface of the valve plate 26 and which overlies the plurality of openings 52. The reed may comprise a thin piece of metal. The reed is anchored at one end, preferably adjacent the leading end of the series of openings 52 of the discharge port 44. The inlet port 40 is not fitted with a valve.

In operation, high pressure fluid from the leading chamber 46 is expelled into the outlet 42 through corresponding ones of the openings 52 that align with the rotational position of leading chamber 46. The reed valve operates as a one-way or unidirectional valve and allows the high pressure fluid to push the distal portion of the reed 54 away from sealing contact with the valve plate 26 in the region covering the corresponding openings 52 associated with the leading chamber 46. Once expelled, the high pressure fluid from the leading chamber 46 cannot enter the one or more trailing chambers due to the presence of the one-way valve 50. Specifically, the pressure on the back side of the reed valve caused by the high pressure fluid expelled from the leading chamber keeps the reed tight and sealed against the valve plate 26 in the region of the openings 52 associated with the position of the trailing chambers 48. Only when the fluid pressure in a trailing chamber(s) 48 exceeds the pressure exerted on the backside of the reed 54 in that area does the reed 54 deflect and allow the fluid to pass, and even then it is one-way so there is no opportunity for higher pressure fluid from the outlet side to enter the chambers during operation. In this way, the trailing chambers 48 are not subject to counterforces exerted by backflow of higher pressurized fluid expelled from the leading chamber 46 that would otherwise occur if the control valve 50 were not present. Recognized benefits include reduced torque in driving the rotor 12 and improved efficiency and performance of the pump 10.

The reed is preferably one-piece and extends across all of the openings 52. The openings are not all of the same size or volume and narrow in accordance with the dimension of the diminishing crescent-shaped space 36 on the discharge side of the pump. The reed 54 is preferable curved and is widest it is base and progressively narrows toward its free distal end.

The inner wall 20 may take the form of a rotatable element. In particular, the inner wall 20 may be provided as an inner surface of an inner race 56 of a bearing 58 that is mounted in the housing 10. Rolling elements 60 support the inner race for rotation relative to both the housing 18 and the rotor 12. While the vanes 16 still slide along the surface of the inner wall 20, the inner wall 20 can also rotate to reduce friction and increase the efficiency of the pump 10.

Figure 3:
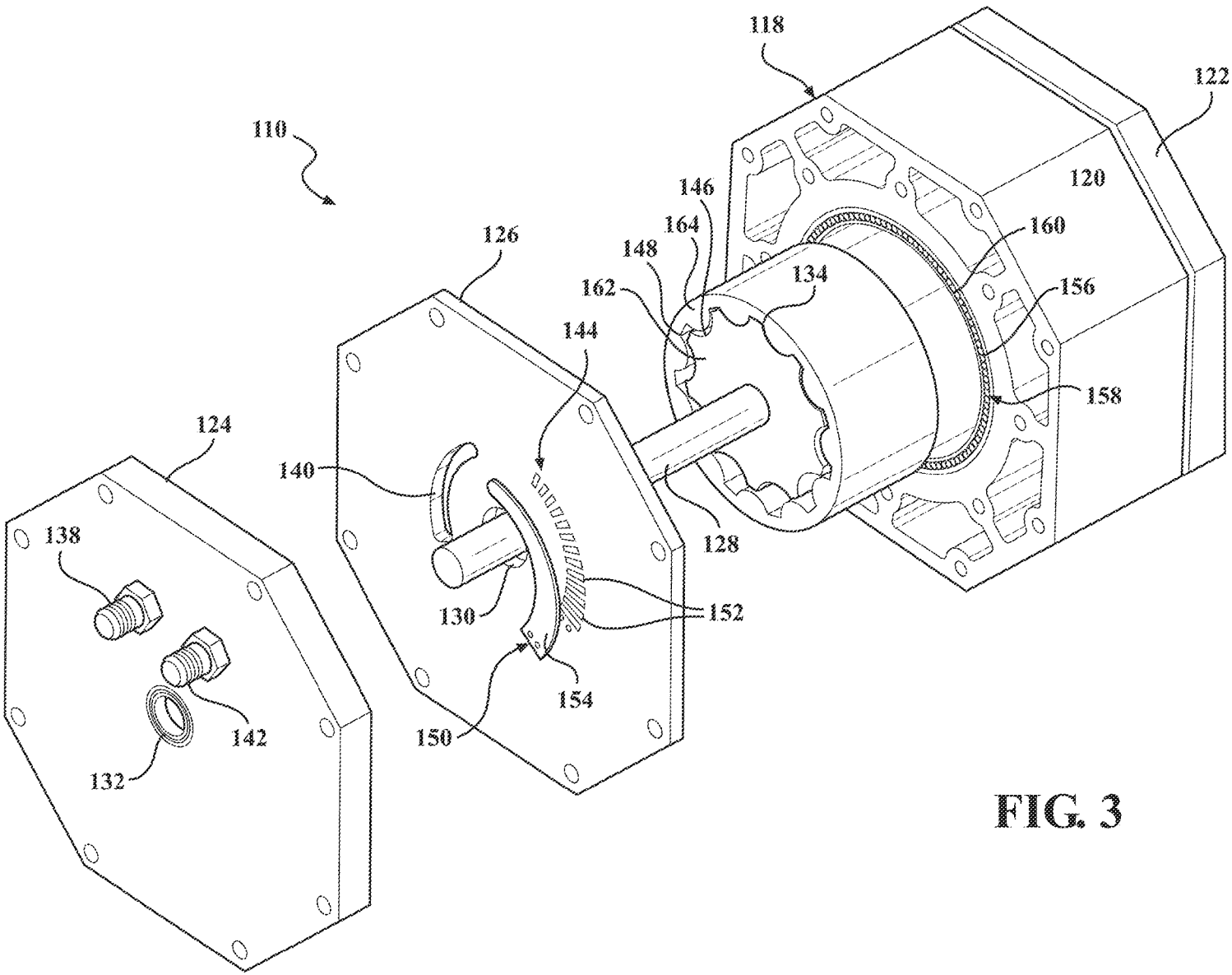
FIG. 3 is an exploded fragmentary perspective view of a positive displacement Gerotor pump according to another embodiment of the invention.
Figure 4:
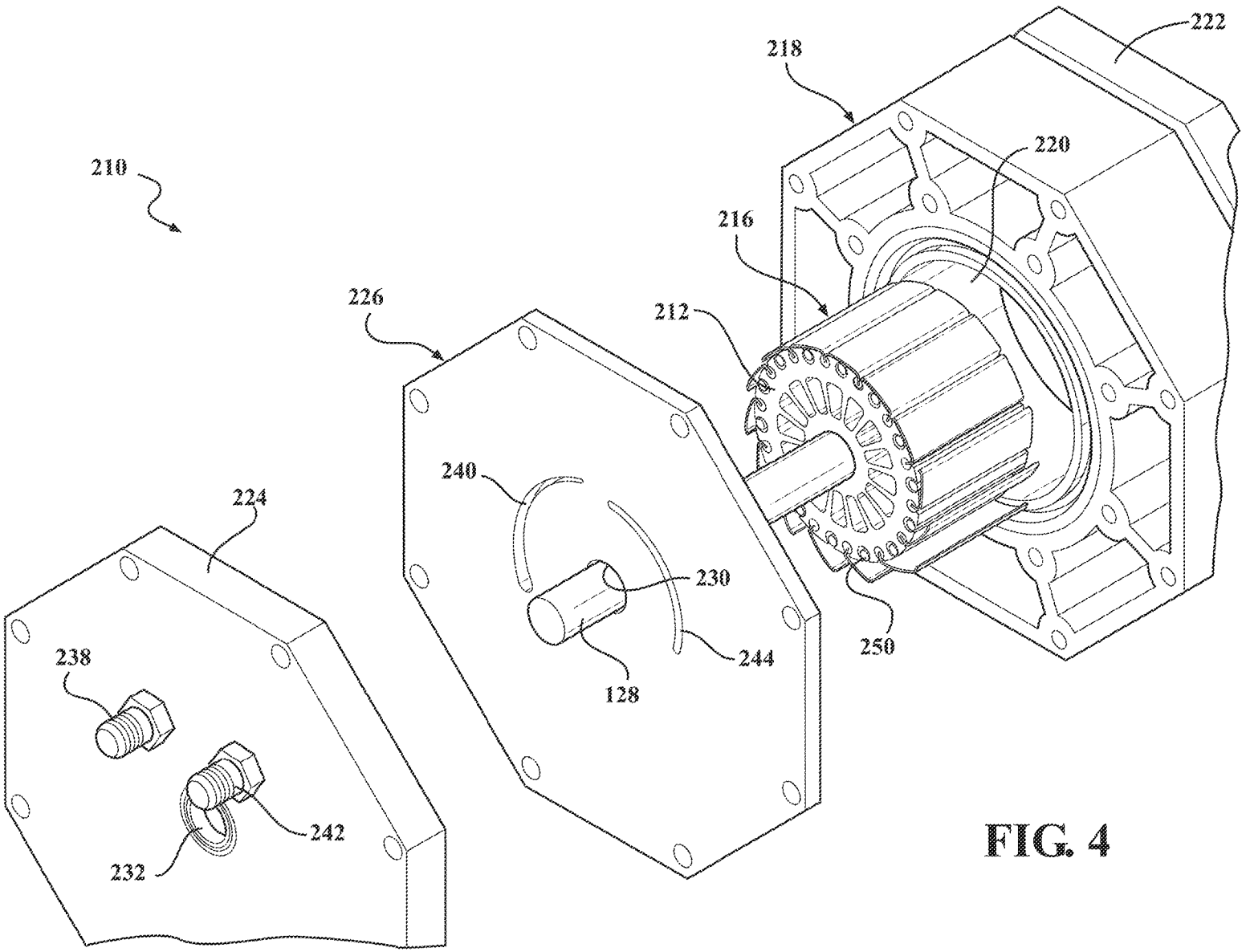
FIG. 4 is an exploded fragmentary cross-sectional view an a positive displacement vane pump according to another embodiment of the invention.
Figure 4C:
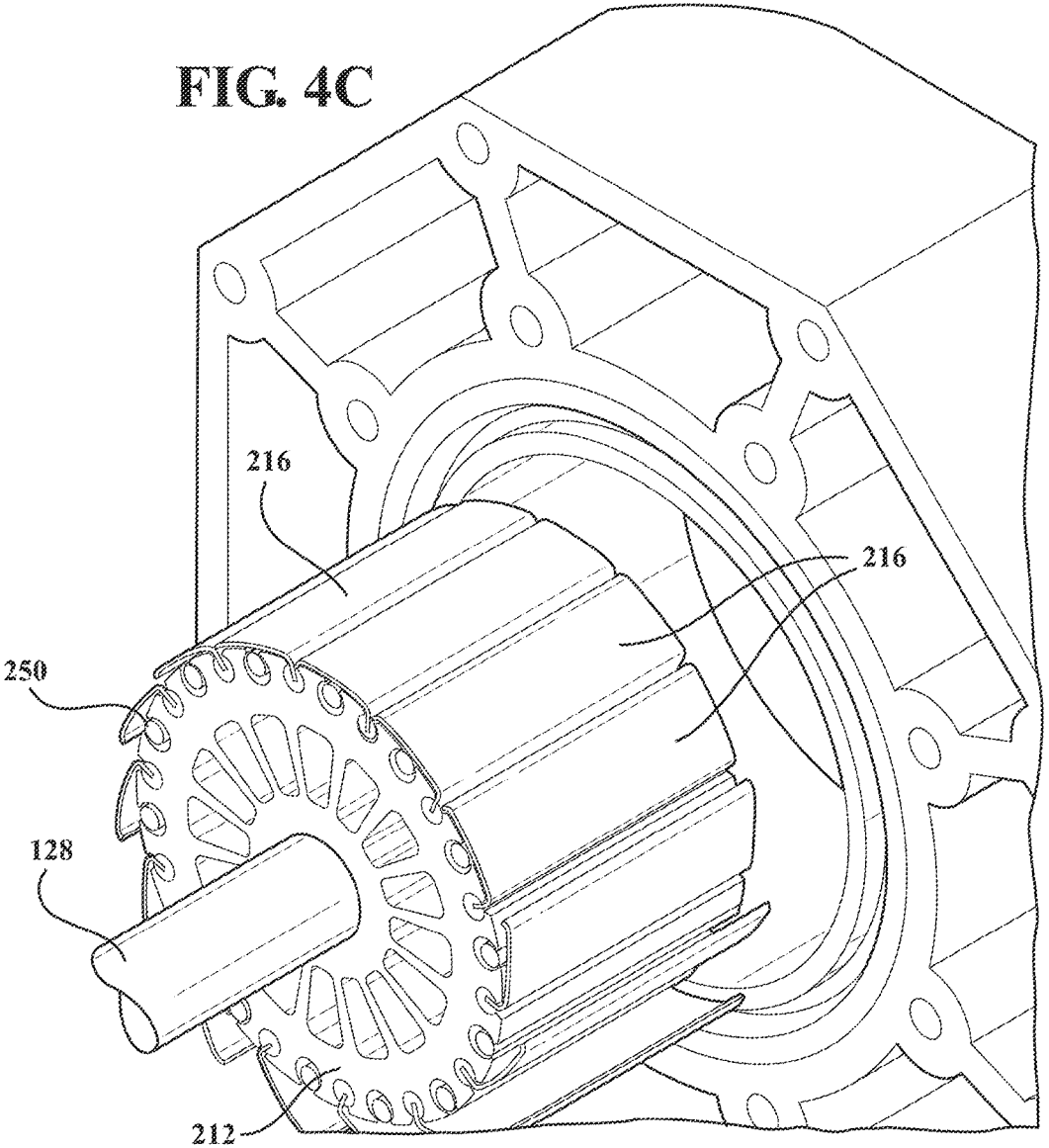
FIGS. 4*a*-4*c* are enlarged fragmentary perspective views of the pump of FIG. 4.
Figure 4A:
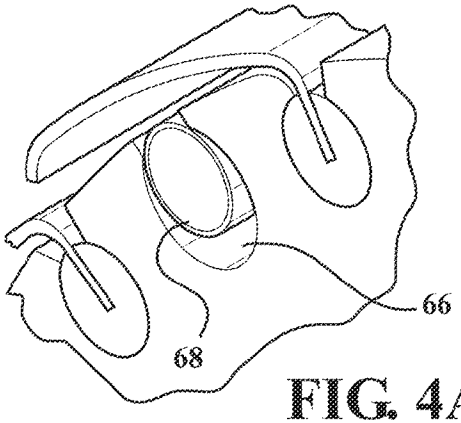
Figure 4B:
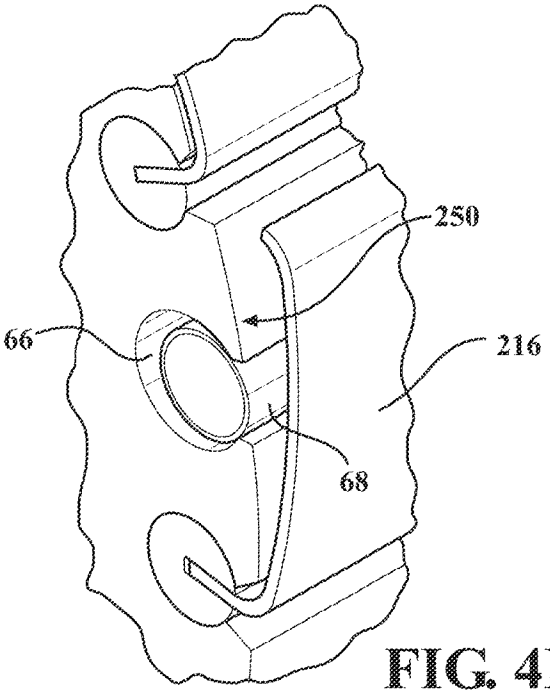

FIG. 3 illustrates another embodiment of a positive displacement pump 110 in the form of a Gerotor pump. The same reference numerals are used to represent like parts, but are offset by 100. The pump 110 includes inner and outer Gerotor gears 162, 164 having n and n+1 teeth, respectively. The inner gear is fixed to a rotatable shaft 128 and the axes of the inner and outer gears are offset to define a variable increasing and decreasing volume of space on a suction side and discharge side of the pump 110, respectively. The pump 110 includes a housing 118 with an inner wall 120 that receives the outer surface of the outer gear 164. The inner wall 120 may comprise a bearing 158 that supports the outer gear 164 for rotation relative to the housing 118. The housing 118 has closed ends and includes at least one end plate 124 and an intervening valve plate 126 that may be the same as described above with respect to the pump 110 of the first embodiment, including the inlet and outlet ports 140, 144 and a control valve 150 at the outlet port 144. The outlet port may similarly be segmented as a plurality of successive and discrete openings 152 walled off from one another. The end plate 124 has a fluid inlet 138 communicating with the inlet port 140 on the suction side of the pump 110 and a fluid outlet 142 communicating with the outlet port 144 on the discharge side of the pump 110.

In operation, the rotation of the inner Gerotor gear 162 in the counterclockwise direction about the axis of the shaft 128 drives the outer gear 164 and as the teeth of the gears roll and slide past one another fluid such as air on the suction side of the pump 110 is drawn in to the pump 110 and becomes trapped in chambers that progressively decrease in volume as the chambers progress toward the close point between the gears on the discharge side of the pump 110. As with the vane pump of the first embodiment, the fluid trapped in the leading chamber 146 near the close point 134 is under the highest pressure and the fluid trapped in trailing chambers 148 is under relatively lower pressure. The high pressure fluid is expelled on the discharge side through the outlet port 144. As with the vane pump above, the openings 152 associated with the position of the leading chamber 146 direct the high pressure fluid out of the chamber, past the reed valve 154 and onto the outlet 142. Once expelled, the fluid is not able to return and specifically is not able to backflow to the trailing chambers 148. The same principles, features and benefits associate with the vane pump 10 are realized by the Gerotor pump 110 when outfitted with the control valve 150.

FIGS. 4 and 4*a-c* illustrate an alternative vane pump 210 embodiment. The same numbers are used to represent like features but are offset by 210. The pump 200 includes a rotor 212, a housing 218, inner wall 220, closed ends including end plate 222 and valve plate 226. The vanes 216 in this case are wing vanes supported at their base ends by the rotor 212 for individual rotation relative to the rotor 212. Rather the sliding outward and inward to maintain engagement with the inner wall 220, the wings pivot outwardly and fold inwardly as necessary during movement through the suction and discharge sides of the pump 210.

The control valve 250 includes at least one opening 66 provided in the rotor 220 between each pair of vanes 216 (in other words, each chamber includes an opening 66) and a valve 68 is provided with each opening 66 to enable pressurized air to escape from the chamber into the outlet ports and outlet 142. The openings 66 may comprise slots and the valve 68 may comprise floating cylinders 68 which seat against edge surfaces of the slots to keep the chambers closed until the fluid pressure in the chambers exceeds the holding force provided by the cylinders. The cylinders 68 may span the full width of the rotor or may extend part way. In operation, high pressure fluid in the leading chamber forces the cylinder 68 of that chamber inward allowing the high pressure fluid to escape through the slot 66 associated with the position of the leading chamber and out of the pump 210. The valves 68 in the trailing chambers remain closed so long as the backside pressure on the cylinders 68 exceeds the pressure in the trailing chambers. The slots 66 are larger than the cylinders 68 such that there is room below the cylinder for the cylinders 68 to move. The slots 66 are in communication with the outlet 244 and communicate fluid only so long as the associated cylinder 68 unseated and is open. The same feature, principles and advantages apply to this embodiment as they do the others.

Obviously, many modifications and variations of the present invention are possible in light of the above teachings. It is, therefore, to be understood that the invention may be practiced otherwise than as specifically described while still being within the scope of the invention.

What is claimed is:

1. A positive displacement rotary fluid pump assembly, comprising:

a pump housing having an inner wall encircling a space disposed about a first housing axis;

a rotor supported within the space of the pump housing for rotation about a second rotor axis offset with respect to the first housing axis and having radially spaced peripheral portions engaging the inner wall to define a plurality of chambers of increasing volume on a low pressure side of the pump and of decreasing volume on a high pressure side of the pump;

a fluid inlet in communication with a plurality of the chambers of increasing volume for admitting fluid into the pump under a first low pressure;

a fluid outlet in communication with a plurality of the chambers of decreasing volume for expelling fluid from the pump under a second higher pressure, the plurality of chambers of decreasing volume chambers including leading-most chambers and trailing—most chambers in relation to the direction of rotation of the rotor;

wherein the pump is a vane pump and includes a plurality of swing vanes supported by the rotor and wherein the pump housing includes end plates covering opposite ends of the housing space in which the rotor is contained;

a fluid control valve provided in the rotor between each pair of the plurality of swing vanes; wherein the fluid control valve includes a plurality of exhaust valves;

wherein each of the plurality of exhaust valves provided in each of the plurality of chambers; and wherein each of the plurality of exhaust valves in each of the plurality of chambers includes a valve slot in the rotor that is open to the respective chamber of the plurality of chambers at a peripheral surface of the rotor and is further open to at least one end of the rotor and including a float valve captured within the valve slot that is moveable between closed position in which the float valve is seated edges of the valve slot to close the valve slot from flow communication with the chamber and an open position in which the float valve is unseated from the slot edges of the valve slot to expel fluid from the respective chamber into the valve slot; and wherein each of the plurality of swing vanes overly each of the plurality of exhaust valve when swung against the rotor.

2. The assembly of claim 1, wherein the pump housing includes an inner sleeve freely rotatable relative to the pump housing and defining the inner surface of the pump housing engagable with the plurality of swing vanes.

3. The assembly of claim 1, wherein the plurality of swing vanes are received in vane slots of the rotor on opposite sides of each valve slot.

* * * * *